United States Patent [19]

Camardo

[11] 4,068,427

[45] Jan. 17, 1978

[54] WALL BRACING ASSEMBLY AND METHOD

[76] Inventor: Gaspare Camardo, 688 Euclid Ave., Elmhurst, Ill. 60126

[21] Appl. No.: 725,726

[22] Filed: Sept. 23, 1976

[51] Int. Cl.[2] ..... E04G 21/18; E04G 21/22

[52] U.S. Cl. ..... 52/127; 52/98; 52/708; 52/749; 248/226.1; 248/354 S; 52/149

[58] Field of Search ..... 52/127, 169, 98, 220, 52/370, 503, 377, 582, 378, 349, 173, 149, 146; 248/354, 354 S, 226 D, 226 R, 226 C

[56] References Cited

U.S. PATENT DOCUMENTS

| | | | |
|---|---|---|---|
| 3,300,920 | 1/1967 | Skaare | 52/150 |
| 3,420,560 | 1/1969 | Pfahning | 52/442 X |
| 3,530,632 | 9/1970 | Sloan | 52/442 X |
| 3,606,231 | 9/1971 | Kilborn | 52/149 X |
| 3,788,026 | 1/1974 | Cook | 52/127 |
| 3,798,856 | 3/1974 | Gloskowski | 52/127 |
| 3,817,006 | 6/1974 | Williams | 52/149 X |
| 3,874,625 | 4/1975 | Hansen | 52/149 X |
| 3,908,956 | 9/1975 | Gates | 52/577 X |

FOREIGN PATENT DOCUMENTS

| | | | |
|---|---|---|---|
| 41,806 | 9/1965 | Germany | 52/584 |
| 529,964 | 6/1955 | Italy | 52/149 |

*Primary Examiner*—Price C. Faw, Jr.
*Assistant Examiner*—Robert C. Farber
*Attorney, Agent, or Firm*—Lockwood, Dewey, Zickert & Alex

[57] ABSTRACT

A temporary wall bracing system is disclosed which is suited for one-sided or two-sided wall application, which wall bracing system includes a framework attached to, and cooperatively associated with, a foundation and anchor plate for bracing a newly constructed brick or masonry wall to enable such wall to withstand wind forces and the like until wall construction and associated permanent bracing is completed. The foundation plate is supported directly on and across the preformed foundation and includes a flange portion which engages the foundation sidewall surface opposite to the side adjacent the framework. The anchor plate is preferably fixed to the ground by means of convergingly oriented steel stakes.

16 Claims, 9 Drawing Figures

FIG. 7
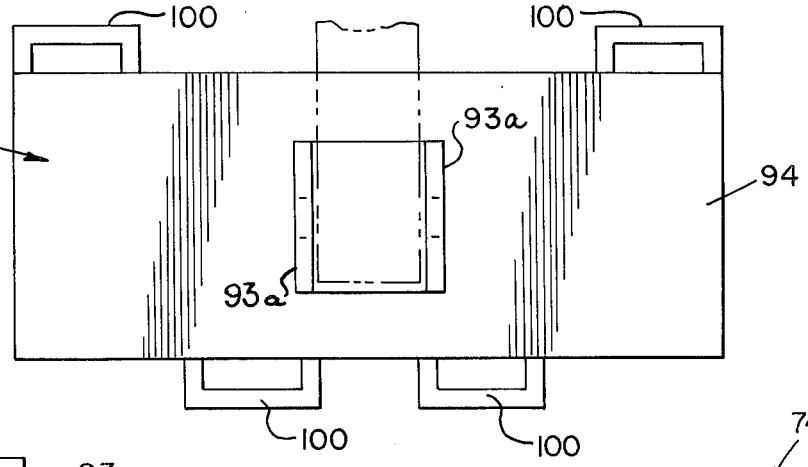
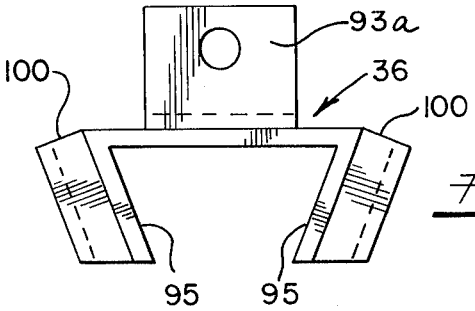
FIG. 8
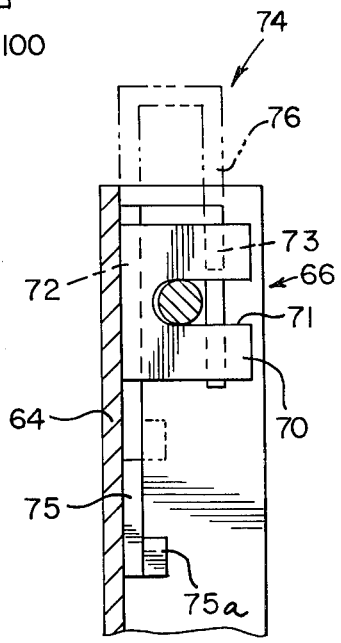
FIG. 6
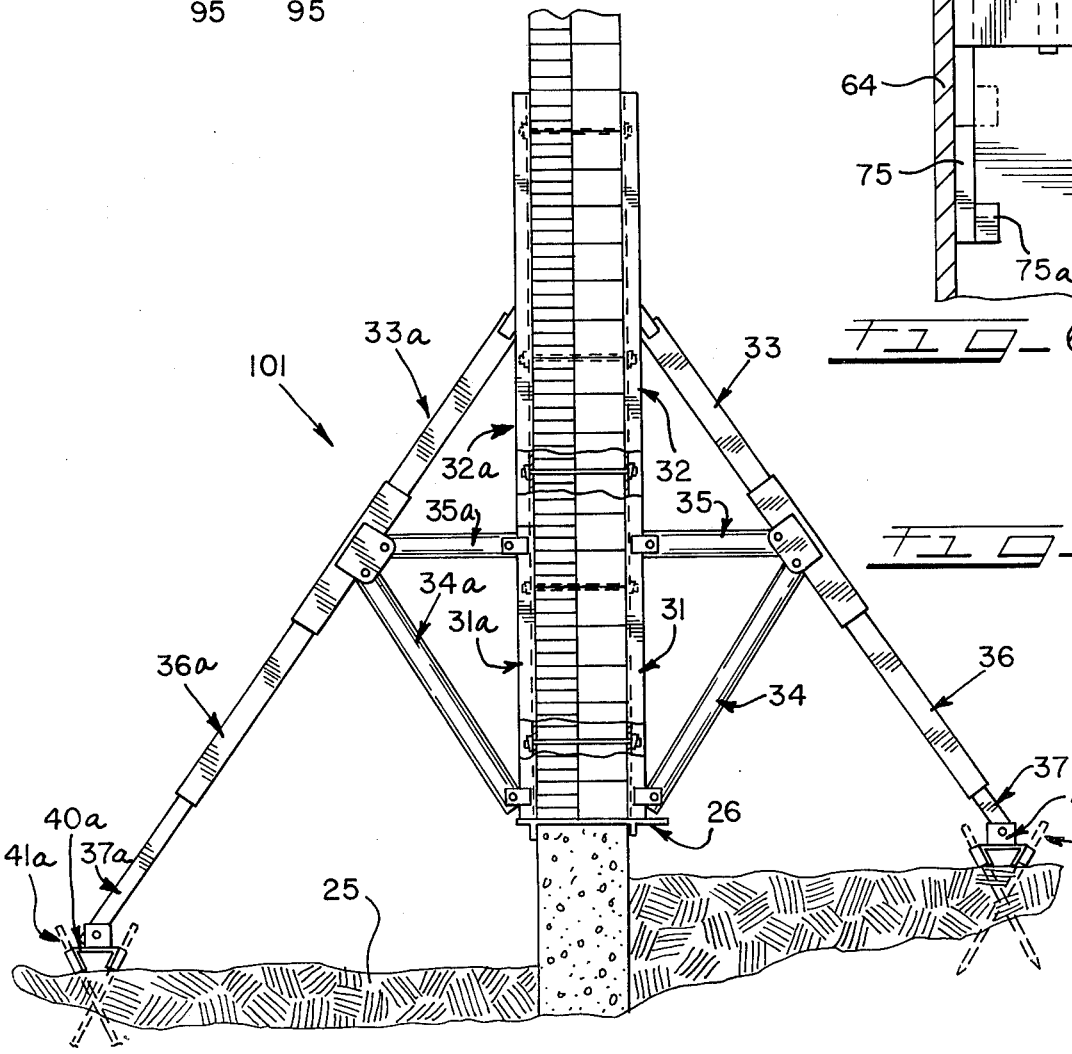
FIG. 9

WALL BRACING ASSEMBLY AND METHOD

BACKGROUND AND DESCRIPTION OF THE INVENTION

This invention generally relates to apparatus for bracing masonry walls against wind damage and the like which may occur during construction of such walls before they are braced permanently by upper floor or roof joists. More particularly, the present invention is directed to an improved wall bracing system which, if desired, can be attached to a single side only of a newly constructed wall to supportingly transfer forces applied against such wall to the associated foundation and ground.

Bracing and support of newly formed free-standing masonry walls from wind forces has long been a problem in the construction industry. This problem is particularly acute in larger buildings such as, for example, commercial buildings, industrial buildings, or public buildings where relatively tall free-standing masonry walls are commonly constructed. When the masonry work is completed, the walls in such structures remain free-standing until the roof framework, upper story framework, or the like has been constructed to permanently support the wall. As such, these free-standing masonry walls are temporarily subject to damage from wind force loads until permanent bracing and associated building construction is completed.

Numerous systems and arrangements have heretofore been proposed for temporarily supporting these newly formed masonry walls. In general, however, these bracing structures have necessitated the use of a dual framework on opposed sides of a free-standing wall in order to provide effective wall support and resistance to forces applied to each side of such wall. As such, these prior art wall bracing systems are excessively costly to purchase and erect, thereby precluding their widespread use in general construction.

In accordance with the present invention, an improved system for bracing a newly constructed masonry wall built upon a foundation from a potential damage caused by high wind forces is provided which includes a wall-engaging framework assembled to, and cooperatively associated with, a foundation plate and anchor plate. The foundation plate is supported directly on and across the preformed foundation and includes a flange portion which engages the foundation sidewall surface opposite to the side adjacent the framework. The anchor plate is preferably fixed to the ground by means of convergingly oriented steel stakes.

It is therefore a general object of the invention to provide an improved apparatus and method for bracing a newly constructed free-standing masonry wall.

Another object of the invention is the provision of a wall bracing system which, if desired, can be effectively attached to a single side only of a free-standing masonry wall for bracing such wall against wind forces and the like whether such forces are applied to that single side or the side opposite thereto.

A further object of the invention is the provision of a wall bracing system attached to a single side of a free-standing masonry wall which includes means for positively anchoring the bracing system directly into the ground adjacent the wall foundation.

A still further object of the invention is the provision of a wall bracing system which transmits wind forces on the wall directly to the foundation.

These and other objects will be apparent to those skilled in this art from the following description of this invention taken in connection with the accompanying drawings, in the several figures of which like reference numerals identify like elements, and in which:

FIG. 6 is a partial sectional view of a releasable, pivotal mounting forming a portion of the wall brace means and taken substantially along line 6—6 of FIG. 3;

FIG. 7 is a plan view of the stake mounting plate portion of the wall bracing system with a portion of an extensible member thereof which is pivotally mounted thereto shown in outline;

FIG. 8 is an end elevation view of the stake mounting plate shown in FIG. 7; and FIG. 9 is an end elevational view, partially in section, of a modification of the invention in which a pair of wall bracing systems are operatively connected to a single foundation plate on both sides of a free-standing masonry wall (with the respective stake plates of each system installed at differing elevations).

Figure 1:
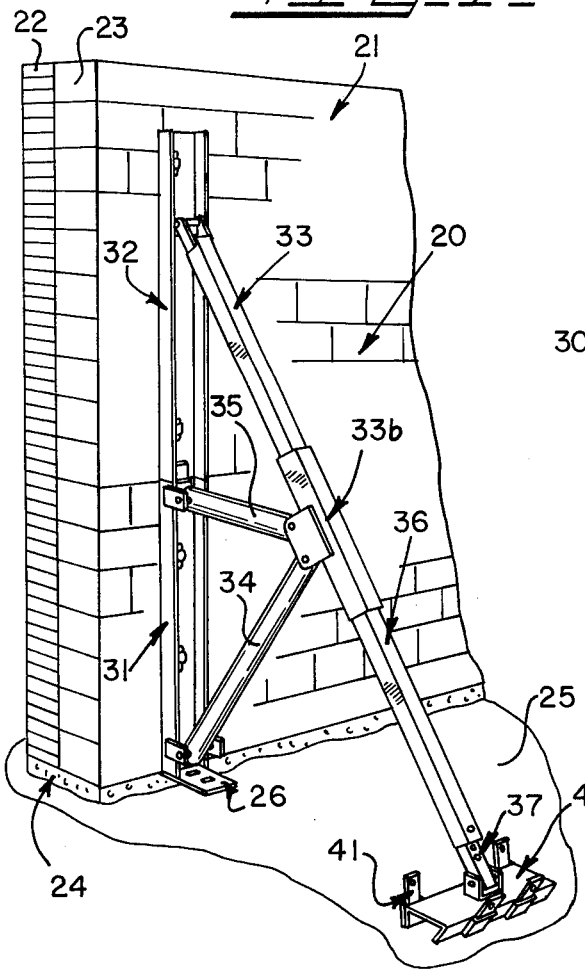
FIG. 1 is a perspective view of an improved wall bracing apparatus constructed in accordance with the invention which is attached to a single side of a free-standing masonry wall.

Referring to FIG. 1, a preferred embodiment of the wall bracing system of the invention is shown generally at 20 connected to one side of a free-standing masonry wall, generally indicated at 21, to brace the same against damage from wind load forces. Free-standing masonry walls which are made at least partly of brick commonly include two wythes, an outer wythe made of brick 22 and an inner wythe also made of brick or, as shown, made of concrete block 23. The entire masonry wall 21 is erected on top of a foundation, generally indicated at 24, of which poured concrete or the like is a preferred material. Foundation 24 can be of known construction and can be formed in any conventional manner, such as for example, pouring concrete into suitable trenching or forming means.

Figure 2:
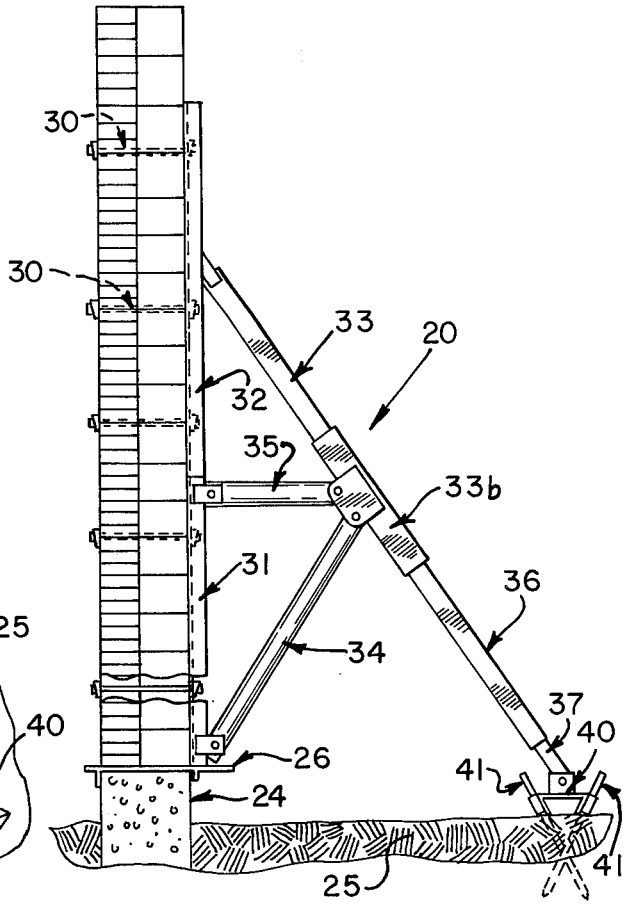
FIG. 2 is a side-elevational view, partially in section, showing the wall bracing system illustrated in FIG. 1.

As shown in FIGS. 1 and 2, the wall bracing system 20 includes a foundation mounting plate 26 which is preferably positioned on top of foundation 24 before a free-standing masonry wall 21 is constructed thereover. Foundation plate 26 is normally placed on the upper surface of the foundation in a horizontal dry mortar joint space of the masonry wall before the wall is erected thereover. After the masonry wall is constructed and supported by the roof (not shown) or other permanent bracing structure, the foundation plate may be removed and mortar then utilized to fill the gap in the joint. During construction of the wall 21, a plurality of snap tie rods 30—30 are mounted through the wall in either the head (vertical) or bed (horizontal) mortar joints therein at appropriate vertically spaced positions to be discussed below. Either during or after construction of the wall 21, a lower wall bracing member 31 is positioned against wall 21, mounted to the top of foundation plate 26, and fastened to the snap tie rods 30—30.

An upper wall bracing member 32 is mounted to the top of lower wall bracing member 31 in this embodiment, and is secured to the wall in like manner by additional snap tie rods 30—30. It should be noted that additional wall bracing members (not shown) may be added to the preferred structure until a desired height of wall brace is obtained.

An upper truss bracing member 33 is pivotally mounted at the top end thereof to upper wall brace member 32 and extends outwardly and downwardly from its top pivotal mounting. A lower truss bracing member 34 is pivotally mounted at the lower end thereof to the lower portion of bottom wall brace member 31, and pivotally mounted at the upper end thereof to the member mounting portion **33*b* of upper truss bracing member 33, thus forming a triangular structure. The vertically mounted upper and lower wall bracing members form the base of the triangle, and the two truss bracing members meet to form the sides of the triangle. An additional strength or deflection member 35 is mounted in horizontal position along the altitude of the triangle. One end of member 35 is pivotally mounted adjacent the top of bottom wall brace member 31 and the other end of member 35 is pivotally mounted to upper truss bracing member 33 at the peak of the truss frame triangle. A collar or member mounting portion 33*b* at the bottom portion of upper truss brace 33 extends outwardly and downwardly from the peak of the triangle to form a strut brace mounting at the lower distal end thereof. A strut brace member 36 is retained in the lower hollow end of mounting portion 33*b* and extends the line of upper truss brace member 33 toward the ground. An extensible member 37 is adjustably mounted on the bottom end of strut brace member 36, and a stake mounting plate 40 is pivotally mounted to the bottom of extensible member 37. The extensibility of member 37 permits the stake mounting plate 40 to be firmly positioned on the ground in spaced-away relation to the foundation 24**.

Stake mounting or anchor plate 40 includes means for mounting a plurality of stakes therethrough from opposing sides of the plate such that the plane of orientation of the various stakes on opposing sides of the stake plate intersect along a line positioned below the surface of the ground. The orientation of the stakes through the anchor plate assures that the strut brace is firmly secured to the ground. The strut brace may then carry loads not only in compression as taught by the prior art, but also in tension. Also, all three truss bracing members 33, 34, and 35 are capable of transmitting loads in compression and tension between the strut brace member 36 and wall bracing members 31 and 32. Therefore, the wall bracing system 20 is capable of supporting the masonry wall 21 against wind damage from winds on either side of the wall even though the bracing system is attached on only one side of it.

Figure 4:
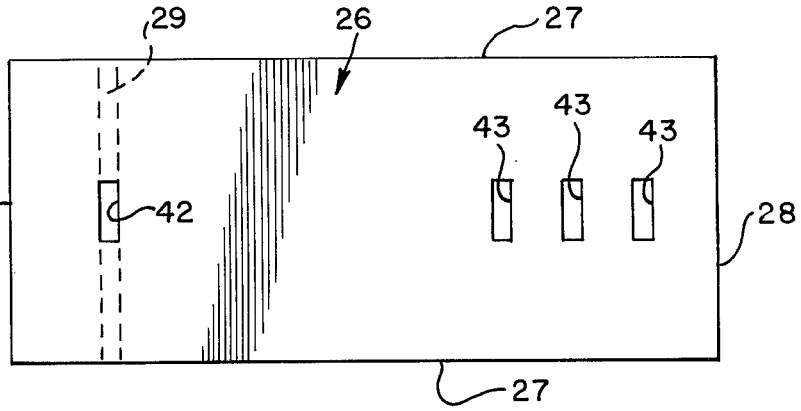
FIG. 4 is a plan view of a foundation plate which forms a part of the wall bracing system of the present invention.
Figure 5:
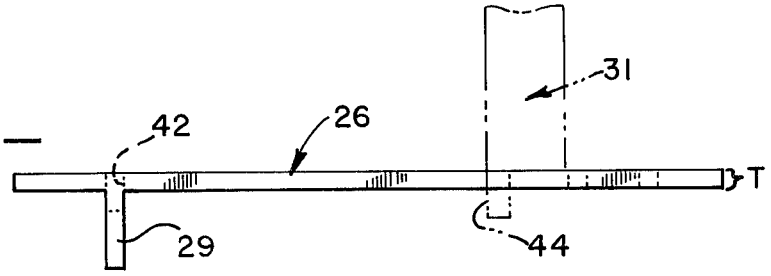
FIG. 5 is a side-elevational view of the foundation plate with a portion of a wall brace apparatus shown in the phantom and mounted to the foundation plate.
Figure 3:
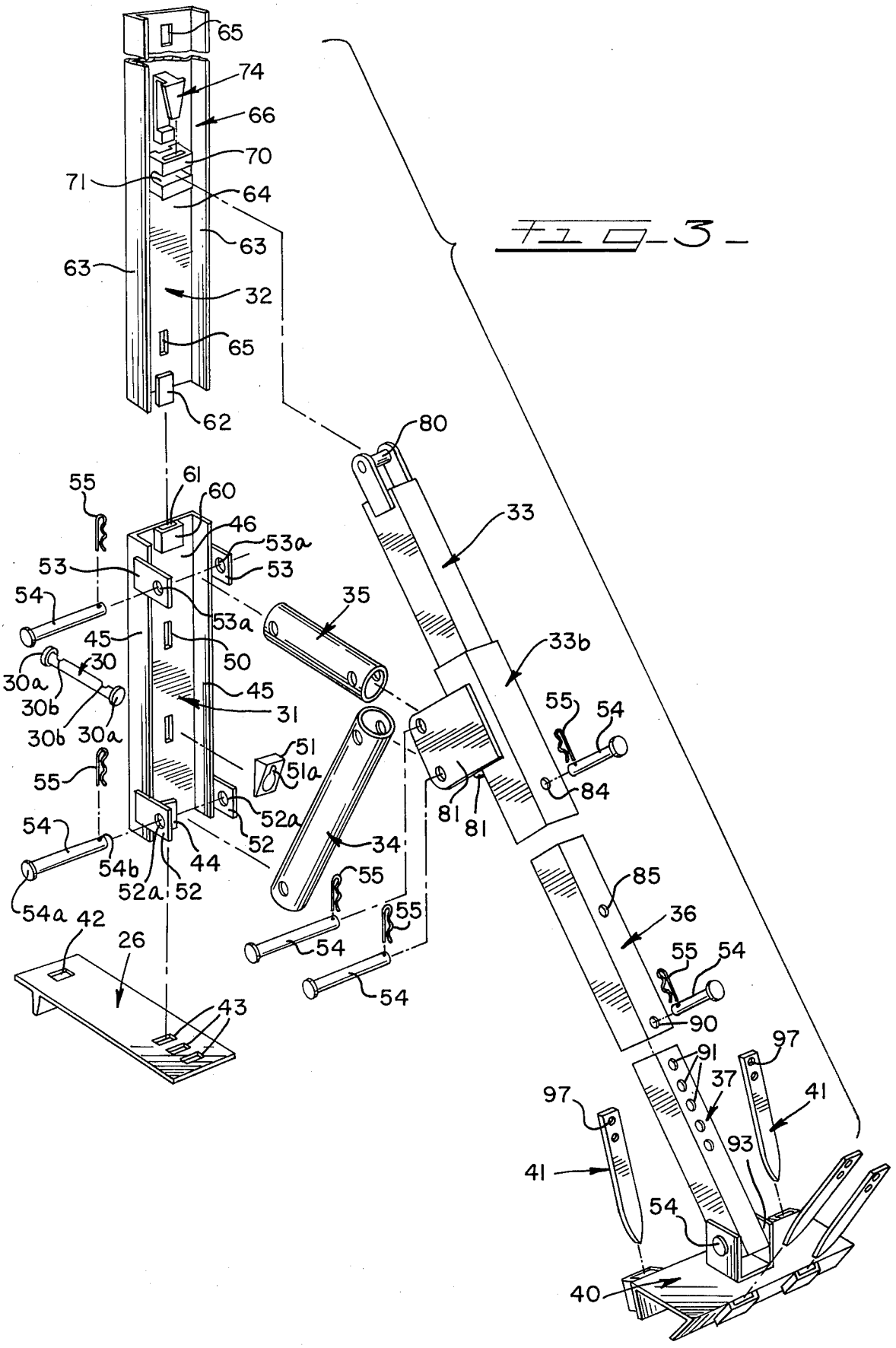
FIG. 3 is an enlarged exploded view of the improved wall brace apparatus of the present invention.

Turning to FIGS. 3 through 8, the various parts and portions making up the wall bracing system 20 of the invention may be described in greater detail. Foundation mounting plate 26 is shown in FIGS. 3, 4, and 5 and is generally a flat, rectangular plate with parallel opposing long sides 27—27, and parallel opposing shorter sides 28—28. A preferred material for plate 26 is steel. The plate 26 is substantially longer and wider than it is thick. The thickness T of mounting plate 26 is no greater than the thickness of a masonry wall bed mortar joint and has a preferred dimension between approximately ¼ and ½ inch. Inwardly adjacent one shorter side 28 of foundation mounting plate 26 is a depending generally rectangular member 29 which is rigidly mounted thereto and extends downwardly from the bottom side of the plate. As the foundation plate is positioned across the top of a foundation, the depending member 29 is positioned against the side of the foundation opposite that side of the wall to be constructed thereover on which the wall bracing members 31, 32 are to be fastened.

While the wall bracing system 20 may be mounted on either side of a free-standing masonry wall, in certain instances, particularly in commercial structures, the ground toward the inside of the foundation is preferred for stake mounting because it has been firmly packed in preparation for having a concrete floor or the like poured therein. In those instances, the depending portion 29 of plate 26 is positioned against the outside vertical surface of the foundation 24. In other instances, each individual bracing assembly may be selectively placed on the side of the masonry wall having firm ground adjacent thereto. Across the longitudinal center line of foundation mounting plate 26 and aligned with depending portion 29 a rectangular aperture 42 extends through plate 26 and into depending portion 29. The function of aperture 42 will be discussed below in connection with the modification of the invention shown in FIG. 9. A plurality of apertures 43—43, having the same dimensions as aperture 42, are also positioned across the longitudinal center line of foundation mounting plate 26 in a spatial relation to each other inwardly adjacent to the opposing end of the foundation plate. In the illustrated embodiment, the center line distance between aperture 42 and each of the purality of apertures 43—43 corresponds to various standard concrete foundation wall dimensions, typically, 8, 10 and 12 inches. Apertures 43—43 serve as mounting holes for a rectangular tongue 44 which extends downwardly from the bottom of lower wall bracing member 31, discussed below.

Each of the plurality of snap tie rods 30—30 is longer than the thickness of the wall 21 through which it is mounted. Each rod 30 has an enlarged head **30*a* at each end thereof. Inwardly adjacent each enlarged head 30*a*, is a notch 30*b* which enables the heads 30*a* to be separated from the body of the rod when struck by a hammer (not shown) or the like. After the supporting structure for the masonry wall has been completed and the wall bracing system 20 is dismantled from the wall, the ends of snap tie rods 30** may be easily broken off and the remaining holes in the mortar joints can be filled with mortar.

The lower wall bracing member 31 is most clearly shown in FIG. 3 and is preferably made of steel or aluminum channel material or the like. The channel structural shape provides strength and rigidity in its parallel side portions 45—45 while including a flat web portion 46 therebetween which abuts the masonry wall surface when the member 31 is mounted on the foundation plate 26. Rectangular tongue 44 which depends from web portion 46, is mounted through one of the foundation plate apertures 43—43 and extends below the plate to abut the other side of the foundation from foundation plate depending portion 29. The coaction of the foundation plate depending portion 29 engaging one foundation sidewall and the tongue 44 of member 31 engaging the opposing foundation sidewall while mounted through the foundation plate secures the bracing system to the foundation. As so mounted, the bracing system is capable of transferring to the foundation wind force loads imparted to the wall. The wind blowing against either side of wall 21 can create a moment around the base of the wall. Since the combination of base plate 26 and tongue 44 firmly grasp foundation 24, any moment forces, whatever their direction, are transferred from the wall to the wall brace, and then to the foundation. Prior art bracing systems are not capable of transferring moments from any direction to the foundation. Along the longitudinal web center line of the lower wall bracing member 31 are a plurality of rectangular, spaced-apart, vertically oriented apertures 50—50 through which the enlarged head ends **30*a*—30*a* of snap tie rods 30—30 are positioned. A plurality of wedge type fasteners 51, including a keyhole shape central aperture 51*a* through each, are capable of fastening the wall brace member 31 to the snap tie rods 30—30. A pair of detent portions 52—52 extend outwardly in parallel spaced-apart fashion from the channel end portions 45—45 of the lower base mounting member 31 adjacent the bottom thereof. Each lower detent portion 52 has an aperture 52*a* extending through it and aligned with the like aperture 52*a* in the opposing detent portion for mounting a retaining pin 54 therethrough. Retaining pin 54 provides a pivotal mounting for one end of lower truss bracing member 34. A hairpin-type retaining clip 55 mounts through hole 54*b* on the distal end of mounting pin 54 to fasten the pin in position. The hairpin clip may easily be removed for dismantling the pivotal mounting. A plurality of these mounting pins 54 and hairpin clips 55 are utilized in other positions in the apparatus. The hairpin clips 55** prevent inadvertent removal of the pins from the structure. All the pins and clips are interchangeable.

Adjacent the top of lower wall brace member 31 and also extending outwardly from the parallel side rails 45—45 are a pair of second detent portions 53—53 similar to detent portions 52—52 discussed above. Detent portions 53—53 include aligned holes **53*a*—53*a* suitable for mounting a second pin 54 therethrough to retain deflection member 35 fastened to the wall brace. A second hairpin clip 55 likewise maintains second retaining pin 54 in mounted position through aligned holes 53*a*—53*a*. At the top of lower wall brace 31 on the inner side of web portion 46, a tongue-retaining member 60 is mounted thereon so as to define a rectangular aperture 61 which is suitable for retaining a tongue which forms the bottommost portion of upper wall brace member 32**.

Upper wall brace member 32 is an extension of lower wall brace member 31 and is constructed similarly thereto. Member 32 is a channel structure having the same cross-sectional dimensions as wall brace member 31, including parallel-opposing side portions 63—63 with a flat web portion 64 therebetween. Upper wall brace member 32 also includes a plurality of slots or apertures 65—65 positioned in parallel-spaced orientation along the longitudinal center line of web portion 64. Apertures 65—65 provide means for extending snap tie rods 30—30 therethrough and fastening same by means of wedge fasteners 51; both previously discussed below in connection with lower wall brace member 31.

Additionally, upper wall brace member 32 includes a drop-bolt type pivotal mounting mechanism, generally indicated at 66 mounted to the inner side of web portion 64 along the longitudinal center line and mediate the ends thereof. Drop bolt pivotal mounting 66, also shown in FIG. 6, includes a generally rectangular housing 70 mounted on the inner side of web portion 64. Rectangular housing 70 includes a horizontal cut-out 71 extending inwardly of the front face of the housing from one side thereof to the other. Cut-out 71 is suitable for mounting a pivot pin 80 on upper truss brace 33 therein. Housing 70 also includes a pair of vertical cut-outs 72, 73 (cut-out 73 being interrupted by cut-out 71) which extend through housing 70 from the top side to the bottom side thereof. A drop bolt member 74, which in the illustrated embodiment is U-shape, is mounted in housing 70 with the straight sides 75 and 76 thereof positioned through cut-outs 72 and 73 respectively such that the bite portion of drop bolt 76 rests on top of the housing. The sides of drop bolt member 74 differ in length with side 75 being longer than side 76. Longer side 75 also includes a detent portion **75*a* at the bottom end thereof which allows the drop bolt to be moved vertically in housing 70 while preventing its removal therefrom. Shorter side 76 is wider than the longer side 75 and is shorter so as to permit access to cut-out 71 when the drop bolt is pushed upward until detent portion 75*a* contacts the bottom of the housing. This drop bolt structure enables the pivotal mounting between upper wall brace 32 and upper truss brace 33** to be connected or disconnected by a person standing on the ground and utilizing a stick, rod, broom handle, or the like to move the drop bolt.

Wind loads on the wall 21 are transferred from the wall bracing members to the foundation and the ground by the truss bracing means and the strut bracing means. The truss bracing means generally include upper truss brace 33 and lower truss brace 34 which meet to form a triangle having wall bracing members 31 and 32 as the base, and the deflection brace 35 which strengthens the triangular framework. The strut bracing means connects the truss bracing means to the ground and generally include strut brace 36, extensible member 37, stake or anchor plate 40, and stakes 41—41. For practical purposes, upper truss brace 33 is also considered a strut brace since strut brace 36 is a linear continuation of brace 33.

More specifically, upper truss brace member 33, in this embodiment, is square and hollow in cross-section, elongated in length, and includes a pin mounting 80 which is capable of pivotal engagement with drop bolt mounting 66 to secure the upper truss brace member to the upper wall brace member 32. In the illustrated embodiment, a collar portion **33*b* is permanently fixed to the lower end of truss brace member 33. As shown, collar portion 33*b* includes a pair of mounting plates 81—81 to which the lower ends of lower truss brace 34 and deflection brace 35 are retained by a plurality of mounting pins 54 and hairpin retainers 55. The lower end of hollow collar 33*b* includes a pair of aligned holes 84—84 (only one shown) therethrough for fastening the upper end of strut brace 36** therein.

Lower truss brace member 34 and a horizontal deflection brace member 35 are simple hollow round tubular structures having pairs of aligned holes positioned through the tubular walls of each member adjacent each end thereof. Preferred materials for truss bracing members 33, 34 and 35 are square or round tubular steel, aluminum, ABS plastic, or the like.

Strut brace 36, in this embodiment, is made of the same structural material as upper truss brace member 33 and includes a first pair of aligned holes 85—85 (only one shown) through the brace which facilitate the attachment of the upper end of the brace to collar **33*b* with a retaining pin 54**. A second pair of aligned holes 90—90 (only one shown) are positioned through strut brace member 36 adjacent the lower end thereof. The hollow tubular structure of strut brace 36 is adapted such that the upper distal end of the extensible member 37 may be nested therein.

A plurality of aligned pairs of holes 91—91 (only one hole of each pair is shown) are positioned along the longitudinal center line of extensible member 37. When the upper end of member 37 is nested inside the hollow lower end of strut brace 36, one of the various pairs of holes 91 may be aligned with holes 90—90 to allow a retaining pin 54 to be positioned therethrough to rigidly mount the members together such that the anchor plate 40, which is pivotally connected to extensible member 37 at U-shaped bracket 93, may rest upon the ground. The strut brace is extensible to adapt the attachment of the bracing system to the ground as fluctuations in ground height may occur at differing positions along a foundation.

The anchor plate member 40, most clearly shown in FIGS. 3, 7, and 8, provides a means for mounting a plurality of metal stakes 41 into the ground in a criss-cross manner so as to securely anchor the strut brace means into the ground. Anchor plate 40 includes a flat rectangular top portion 94 and two elongated rectangular side panels 95—95 depending from the longest sides of the rectangular top portion in an acute angular relationship therewith such that if the panels were extended downwardly they would intersect at a point below the ground upon which the stake plate is positioned. The legs 93*a* of U-shaped bracket are generally centrally located on the upper side of top portion 94 to provide for pivotally mounting extensible member 37 thereto with a retaining pin 54. A plurality of channel shape stake retaining members 100 are securely mounted by their distal ends to the outer surfaces of side plates 95—95, thus providing hollow interior apertures which are slightly larger than the cross-section of one of the stakes 41 to snugly receive such stakes in firmly anchoring relationship therewith.

Stake retaining members 100 are mounted on side plates 95—95 in aligned relation with other stake retaining members 100 on the same side plate, and in staggered relation with stake retaining members on the opposite side plate. This staggered arrangement allows the stakes mounted through the stake retaining members to criss-cross in skewed relation below ground level to provide a superior ground anchoring for the same. A preferred staggered arrangement may be clearly seen in FIGS. 1, 2, 3, and 7. In the preferred embodiment, the stakes 41 which are aligned almost perpendicular to the strut brace means are positioned on the side of the anchor plate 40 mounted farthest from the wall brace members 31, 32, and are positioned on either side of the extensible member 37 closely adjacent thereto. The stakes 41 mounted through the stake retaining members on the side of anchor plate 40 closest the wall bracing members 31, 32, are driven into the ground at a position close to being parallel to the strut brace means. These latter stakes are positioned further outwardly of extensible member 37 than the first pair of stakes described.

The stakes 41—41 are generally elongate, of rectangular cross-section, and include a pointed bottom end which is driven into the ground and a flat top end which provides a means for absorbing hammer blows or the like. Stakes 41 may also contain holes 97 therethrough for mounting members (not shown) therein to provide ease of removal of the stakes from the ground when desired. A preferred material for stakes 41—41 is steel, a tough aluminum alloy, or the like.

In certain extreme instances, such as when severe storms and wind conditions are predicted, it may be desirable to provide bracing members on both sides of a free-standing masonry wall. For the few instances when this may be necessary, the apparatus of applicant's invention provides for the easy addition of a second truss bracing system mounted upon the opposing of the masonry wall from the original system described in the first embodiment. This dual mounted bracing system is shown in FIG. 9 and generally indicated at 101. With the exception of the original foundation plate 26 and, the original tie rods 30—30, the remaining members of the first embodiment of the wall bracing system are simply doubled in number to provide the second embodiment of the invention. The previously described hole 42 in foundation plate 26 provides a means for mounting the bottom tongue 44*a* of the second lower wall bracing member 31*a* thereto. The wedges 51 which, in the previous embodiment, wedged the tie rods directly to the masonry wall 21 in the first embodiment, are utilized to mount the lower and upper wall bracing members 31*a*—32*a* to the opposing side of the wall. The upper truss bracing member 33*a*, lower truss brace member 34*a*, deflection member 35*a*, strut brace member 36*a*, extensible member 37*a*, anchor plate 40*a*, and stakes 41*a* are assembled in identical manner as described in the first embodiment. As shown, extensible member 37*a* is mounted in strut brace 36*a* in an extended position from extensible member 37 which is mounted in strut brace 36. Frequently, one side of the grade elevation will be higher or lower than the opposing side throughout the length of that side of the masonry wall. Therefore, each strut brace is adjustable in length to provide for varying grade heights.

While two embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An assembly for temporarily bracing a newly constructed masonry wall built upon a foundation, said assembly comprising: a vertically extending support member having a surface adapted to engage a face of said masonry wall; a bracing member having an upper end connected to an upper portion of said support member and extending downwardly and outwardly therefrom; a horizontally extending support plate adapted to removably extend through a bed joint in a masonry wall in overlying relationship with said foundation; said horizontally extending support plate including an upper surface which supportingly receives said vertically extending support member and a flange portion adapted to engage a vertical sidewall face on one of said foundation or said masonry wall which is oppositely disposed to the face of said masonry wall in engagement with said support member; and, means for resisting shifting of said foundation plate transversely to said wall.

2. The assembly of claim 1 wherein means is provided for securing said support member to said masonry wall.

3. The assembly of claim 1 wherein the lower end of said bracing member is connected to an anchor plate which is in engagement with the ground and which includes a pair of opposed stakes extending into the ground through said anchor plate and arranged in converging relationship to each other.

4. The assembly of claim 1 wherein said support member coacts with said horizontally extending support plate for directing forces from any direction acting on said wall to said foundation.

5. The assembly of claim 3 wherein said bracing member coacts with said support member and said anchor member for directing forces from any direction acting on said wall into the ground.

6. The assembly of claim 1 further including a truss frame member mounted at one end thereof to said support member and at the opposing end thereof mounted to said bracing member mediate the ends thereof.

7. An assembly for bracing a masonry wall built upon a foundation from wind forces during construction; said assembly comprising: fastening means extending through a masonry wall in spatial vertical orientation therein; wall bracing means mounted to said fastening means on one side of said wall, said bracing means positioned vertically on said wall and extending downward to a foundation upon which said wall is built; and base mounting means removably mounted on said foundation across the thickness thereof for transferring forces of any directional orientation from said wall bracing means mounted thereto to said foundation.

8. The assembly of claim 7 wherein said base mounting means includes a foundation plate which is adapted to extend across the top of said foundation through a bed mortar joint space and includes a downwardly extending portion for retaining said member against one side surface of said foundation, and means on said foundation plate for mounting said bracing means therethrough and retaining a bottom portion of said bracing means against an opposing side surface of said foundation.

9. An assembly for shoring a free-standing masonry wall on top of a foundation to prevent damage from wind forces which may occur to the wall during construction, said assembly comprising: a foundation plate capable of extending across the top of a wall supporting foundation for transmitting forces of any directional orientation from said assembly to said foundation, a wall brace member adapted to be positioned vertically contiguously with one side of a masonry wall constructed on top of said foundation, a plurality of fastening means extending through said masonry wall and adapted to engage said wall brace member for maintaining same contiguous with said masonry wall, a strut brace means mounted at one end to said wall brace member, said strut brace means being of adjustable length and extending angularly downward from said mounting to the ground adjacent said foundation, and truss bracing means mounted to and between said strut brace means and said wall brace member at positions mediate their respective ends.

10. The assembly of claim 9 wherein said foundation plate includes a base portion which is flat, wide and long relative its thickness, its thickness being less than that of a bed mortar joint between said foundation and said masonry wall for positioning through a space in said bed mortar joint, said foundation plate including a detent portion positioned generally perpendicular to the plane of said base portion for extending downward therefrom contiguous with a side of said foundation for imparting forces thereto, and a wall brace mounting aperture through the thickness of said base portion for enabling a tongue on said wall brace to extend downwardly therethrough contiguous with an opposing side of said foundation for imparting forces thereto.

11. The assembly of claim 9 wherein said fastening means includes a tying rod capable of being positioned through said masonry wall in a mortar joint therein, said tying rod having enlarged ends adapted to coact with wedge fastener means, wedge fastener means positioned at one end of said rod for fastening said rod directly to said masonry wall surface, and wedge fastener means positioned at the other end of said rod for fastening said wall brace to said masonry wall.

12. The assembly called for in claim 9 further including an anchor plate pivotally mounted to the lower end of said strut brace, and a pair of stakes adapted to be positioned through said anchor plate at an incline toward each other and into the ground for positively anchoring same thereto.

13. An assembly for maintaining a masonry wall in free standing position on top of a foundation and preventing damage from wind forces during construction, said assembly comprising: a wall brace member adapted to be mounted to a masonry wall constructed on top of a foundation, fastening means in said wall which engage said wall brace member, a strut brace means adapted at one end for mounting to said wall brace member and including a plurality of stakes, and an anchor plate pivotally mounted to the bottom of said strut brace means for positioning said stakes therethrough wherein the planes defined by said stakes intersect.

14. A method for shoring a free-standing masonry wall on top of a foundation for preventing damage to said wall from wind forces during its construction, said method comprising the steps of: positioning a foundation plate across a portion of one side and the top of a foundation on which a masonry wall is to be constructed; inserting fastening members in vertical spaced orientation through mortar joints in said wall as it is being constructed; positioning a wall bracing means contiguous with one side of said wall, through said foundation plate, and into communication with an opposing side of said foundation for transmitting forces thereto; engaging said fastening members to said wall bracing means on one side of said wall, and to said wall on the other side thereof; and mounting a strut bracing means to said wall bracing means, said strut bracing means extending angularly outwardly and downwardly therefrom into anchored communication with the ground adjacent said wall foundation.

15. The assembly as described in claim 1 wherein said flange portion is adapted to engage said masonry wall.

16. The assembly as described in claim 1 wherein said flange portion is adapted to engage said foundation.

* * * * *